United States Patent [19]

Fogleman et al.

[11] Patent Number: 4,686,912

[45] Date of Patent: Aug. 18, 1987

[54] ELECTRICALLY CONTROLLED LOCKING APPARATUS AND SAFE UTILIZING SAME

[75] Inventors: H. Frank Fogleman; Randall E. Parrish, both of San Diego, Calif.

[73] Assignee: The Protech Partnership, San Diego, Calif.

[21] Appl. No.: 723,547

[22] Filed: Apr. 15, 1985

[51] Int. Cl.[4] ..... E05G 1/04; E05B 49/00

[52] U.S. Cl. ..... 109/59 T

[58] Field of Search ..... 109/59 T, 31, 38, 59 D, 109/58; 70/278

[56] References Cited

U.S. PATENT DOCUMENTS

| | | | |
|---|---|---|---|
| 2,953,689 | 9/1960 | Becker | 70/282 |
| 3,812,403 | 5/1974 | Gartner | 70/278 |
| 3,831,408 | 8/1974 | Featherman | 70/278 |
| 3,893,723 | 7/1975 | Boule | 292/144 |
| 3,926,021 | 12/1975 | Genest et al. | 70/278 |
| 4,148,092 | 4/1979 | Martin | 70/278 |
| 4,412,216 | 10/1983 | Mole et al. | 70/278 |
| 4,457,148 | 7/1984 | Johansson et al. | 70/278 |
| 4,486,751 | 12/1984 | Mole et al. | 70/278 |
| 4,534,194 | 8/1985 | Aydin | 70/278 |

FOREIGN PATENT DOCUMENTS

| | | | |
|---|---|---|---|
| 978228 | 11/1975 | Canada | 292/144 |
| 10345 | of 1910 | United Kingdom | 292/144 |

*Primary Examiner*—James L. Ridgill, Jr.

*Attorney, Agent, or Firm*—Bernard L. Kleinke

[57] ABSTRACT

The electronically controlled locking apparatus is used with a door such as a safe door, and enables the door to be released by either a mechanical combination lock or an electrical lock control circuit. The control circuit generates an output signal when a correct access code is entered by a user for causing a control linkage to release the door. Alternatively, the mechanical lock can also cause the control linkage to release the door by authorized personnel, in the event of either a control circuit malfunction, or the authorized user being unable to recall the access code. The circuit includes both a non-volatile and a volatile memory means for storing the access code, and a display device for providing a visual indication of the correct code within the protected area, so that the door can be unlocked with the mechanical lock, and then the access code for the electrical lock circuit can be viewed at the protected side of the door.

21 Claims, 13 Drawing Figures

53A
33
106
331
47
46
52
49
34
10
18
12
14
36
37
161
163
16
55
38
43
45
57
21
41
26
29
27
35
32A
25B
32
25A
23
109
25
30

OPTIONS
103
105A
105
DIAGNOSTICS
OPTIONS
101B
SAFE
OPTIONS
100B
104
101A
104A
101
100
99A
100A
99
95
CARD
CODE
97
+5V
98A
98
X6
X7
A0
A3
A2
A1
99B
98B
TO FIG. 5

FROM FIG. 3
99B
98B
100B
101B
RST
TO FIG. 6
X7
X6
LOCKED
TP4
SILENT ALARM CKT.
270
DE-MUX. U3
74HC138
96
+5V
B0
B1
B2
B3
KEY B
SELECT
RESET
+A
48
48A
5MHZ PARALLEL
XTAL1
XTAL2/CLK
÷2
15PF
MICRO-COMPUTER
82
87
TO FIG. 7
SHUT DOWN
HI. VOLT. OFF
SGS L387 REGULATOR U6
125
124
125A
125B
DISRUPTION SWITCH
10/15E
10/15
3.3K
.1
1N4001
3300/16E
2Ω/2W
1200Ω
220μH
27K
510
1K
80
VCC
CLS
TC
U15
SWITCHING REGULATOR
TE
SUB
TL497

FROM FIG. 4
TO FIG. 8
TO FIG. 5
DE-MUX U4
74HC138
BCD DECODE
2N3904
KEY B
INT1
RST
RESET
SELECT
+5V
3.3K
10K
100K
47K

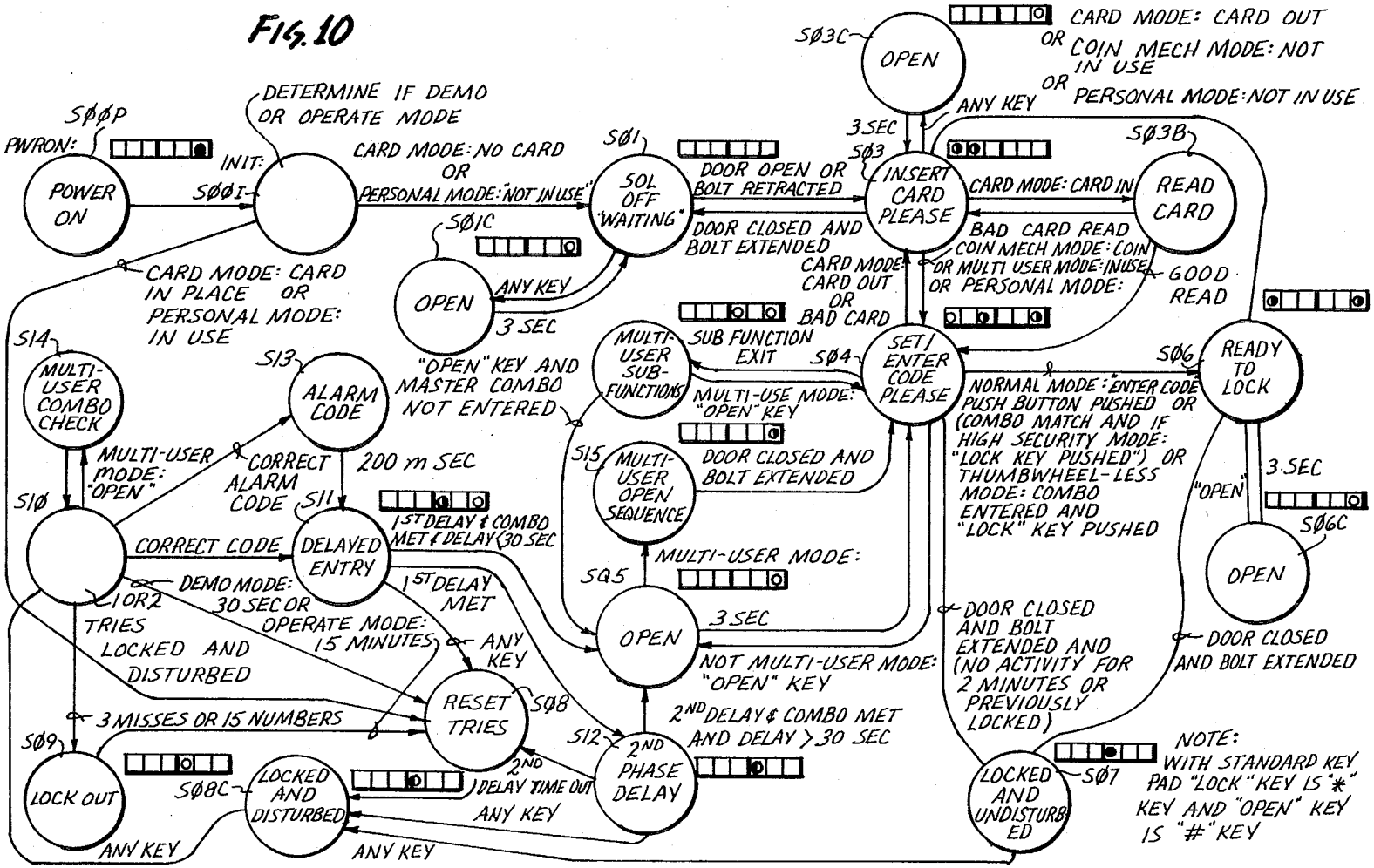
FIG. 10
DETERMINE IF DEMO OR OPERATE MODE
CARD MODE: NO CARD OR PERSONAL MODE: NOT IN USE
CARD MODE: CARD IN PLACE OR PERSONAL MODE: IN USE
INIT: S001
S00P
PWRON:
POWER ON
S14
MULTI-USER COMBO CHECK
MULTI-USER MODE: "OPEN"
S10
CORRECT CODE
DEMO MODE: 30 SEC OR OPERATE MODE: 15 MINUTES
1 OR 2 TRIES LOCKED AND DISTURBED
3 MISSES OR 15 NUMBERS
S09
LOCK OUT
ANY KEY
S08C
LOCKED AND DISTURBED
S13
ALARM CODE
200 m SEC
CORRECT ALARM CODE
S11
DELAYED ENTRY
1ST DELAY & COMBO MET & DELAY > 30 SEC
1ST DELAY MET
ANY KEY
S08
RESET TRIES
2ND DELAY TIME OUT
S12
2ND PHASE DELAY
2ND DELAY & COMBO MET AND DELAY > 30 SEC
S01
SOL OFF WAITING
S01C
OPEN
3 SEC
"OPEN" KEY AND MASTER COMBO NOT ENTERED
S15
MULTI-USER SUB-FUNCTIONS
MULTI-USE MODE: "OPEN" KEY
DOOR CLOSED AND BOLT EXTENDED
MULTI-USER OPEN SEQUENCE
MULTI-USER MODE:
S05
OPEN
NOT MULTI-USER MODE: "OPEN" KEY
DOOR OPEN OR BOLT RETRACTED
DOOR CLOSED AND BOLT EXTENDED
CARD MODE: CARD OUT OR BAD CARD
SUB FUNCTION EXIT
S04
SET/ ENTER CODE PLEASE
NORMAL MODE: ENTER CODE PUSH BUTTON PUSHED OR (COMBO MATCH AND IF HIGH SECURITY MODE: "LOCK KEY PUSHED") OR THUMBWHEEL-LESS MODE: COMBO ENTERED AND "LOCK" KEY PUSHED
DOOR CLOSED AND BOLT EXTENDED AND (NO ACTIVITY FOR 2 MINUTES OR PREVIOUSLY LOCKED)
LOCKED AND UNDISTURBED
S07
NOTE: WITH STANDARD KEY PAD "LOCK" KEY IS "*", KEY AND "OPEN" KEY IS "#" KEY
S03
3 SEC
INSERT CARD PLEASE
CARD MODE: CARD IN
BAD CARD READ
COIN MECH MODE: COIN OR MULTI USER MODE: IN USE OR PERSONAL MODE:
GOOD READ
S03B
READ CARD
S06
READY TO LOCK
"OPEN"
3 SEC
S06C
OPEN
DOOR CLOSED AND BOLT EXTENDED
S03C
OPEN
ANY KEY
CARD MODE: CARD OUT OR COIN MECH MODE: NOT IN USE OR PERSONAL MODE: NOT IN USE

SYMBOL DEFINITION
MACHINE STATE DESCRIPTION

STATUS INDICATORS

| | "INSIDE SAFE" | | | "ON FRONT OF SAFE DOOR" | | |
|---|---|---|---|---|---|---|
| MEANING | ALARM | ENTER CODE | INSERT CARD | LOCKED | * | OPEN |
| COLOR / FREQUENCY | 1200HZ | GRN | YEL | GRN | YEL | RED |

*NOT ASSIGNED

- OFF
- BLINK (.3 SEC ON, .7 SEC OFF)
- WINK (.7 SEC ON, .3 SEC ON)
- STEADY (ALWAYS ON)

ELECTRICALLY CONTROLLED LOCKING APPARATUS AND SAFE UTILIZING SAME

DESCRIPTION

TECHNICAL FIELD

The present invention relates in general to an electrically controlled locking apparatus, and more particularly relates to locking apparatus for lockable doors, such as safe doors.

BACKGROUND ART

There have been different types and kinds of electronically controlled locking mechanisms for lockable doors, such as safe and vault doors. In this regard, electronic digital locks have been employed for safes, and such locks include key pads for entering access codes for releasing the safe doors. With such an arrangement, the door can be quickly and easily unlocked, by entering manually the correct access code, by depressing the proper sequence of keys on the key pad.

While such an arrangement may be satisfactory for some applications, it may be desirable to have such an electronically lockable door, which can be unlocked in the event that an authorized user is unable to remember the correct combination code, or in the event of a malfunction of the locking apparatus. One approach to solving this problem has been to employ a separate mechanical key locking arrangement for unlocking the safe door. However, such an arrangement is not entirely satisfactory since key locks can be picked, or otherwise opened by unauthorized persons and require key control.

Therefore, it would be highly desirable to have an improved electronically controlled apparatus for locking doors, which can be locked by manually entering a code, as well as by other secure techniques in a convenient manner. Also, it would be highly desirable to enable the access code to be initially entered in the electronically controlled apparatus, and at the same time, be readily ascertainable by authorized personnel only, should the alternate unlocking apparatus need to be actuated.

Moreover, with prior known electronically controlled locking apparatuses, unauthorized persons attempting to gain access to the protected area, have employed externally-used high voltage generators to cause the apparatus to release the door. Therefore, it would be highly desirable to have such an apparatus, which cannot be activated by unauthorized persons using such high voltage generators, or at least making it highly unlikely that such devices would be able to activate the locking apparatus. It would also be highly desirable to have such an electronic locking apparatus, which could be used according to multiple modes of operation. In this regard, such apparatus should be usable for personal use, in-room hotel and motel use, coin operation, or others.

DISCLOSURE OF INVENTION

Therefore, the principal object of the present invention is to provide a new and improved electrically controlled locking apparatus, which enables convenient access to protected areas by authorized personnel only, and which enables access to be provided by alternative techniques in a secure manner.

Another object of the present invention is to provide such a new and improved electrically controlled locking apparatus, which not only facilitates rapid access to a protected area by an authorized user, but also enables the authorized user to enter readily and conveniently a desired new access code and cause it to be displayed to authorized users in the protected area only.

Still another object of the present invention is to provide such a new and improved electrically controlled locking apparatus, which can defeat, or at least greatly reduce, the possibility of unauthorized persons from gaining access to protected areas by the use of high voltage generators, and which can be used for multiple purposes, including personal use, hotel and motel in-room use, coin mechanism use, and others.

A further object of the present invention is to provide such a new and improved electrically controlled locking apparatus, which possesses functional integrity, and thus is able to return to normal operation automatically following a temporary disruption or disfunction, such as a mechanical abuse, temporary electronic failure, and the like.

Briefly, the above and further objects of the present invention are realized by providing a new and improved electrically controlled locking apparatus, which provides alternative access to protected areas by authorized personnel only.

The electronically controlled locking apparatus is used with a door such as a safe door, and enables the door to be released by either a mechanical combination lock or an electrical lock control circuit. The control circuit generates an output signal when a correct access code is entered by a user for causing a control linkage to release the door. Alternatively, the mechanical lock can also cause the control linkage to release the door by authorized personnel, in the event of either a control circuit malfunction, or the authorized user being unable to recall the access code. The circuit includes nonvolatile devices for storing the access code, and a display device for providing a visual indication of the correct code within the protected area, so that the door can be unlocked with the mechanical lock, and then the access code for the electrical lock circuit can be readily viewed at the protected side of the door.

The functional utility of the system remaining intact following a disruption results from several design features. One such feature relates to the use of the nonvolatile memory devices. Also, such functional utility results from the use of two dissimilar locks acting independently upon a common locking mechanism, so that a condition or disfunction that might render one of the devices inoperable, would not so impair the alternative lock, thereby maintaining its utility.

BRIEF DESCRIPTION OF DRAWINGS

The above-mentioned and other objects and features of this invention and the manner of attaining them will become apparent, and the invention itself will be best understood by reference to the following description of an embodiment of the invention taken in conjunction with the accompanying drawings, wherein:

FIG. 9A is a schematic circuit of the battery circuit, shown as a functional block shown in FIG. 7;

FIG. 10 is a flow chart diagram, useful in understanding the computer program stored in the microcomputer of the locking control circuit, as shown in FIG. 2.

BEST MODE FOR CARRYING OUT THE INVENTION

Figures 1, 2:
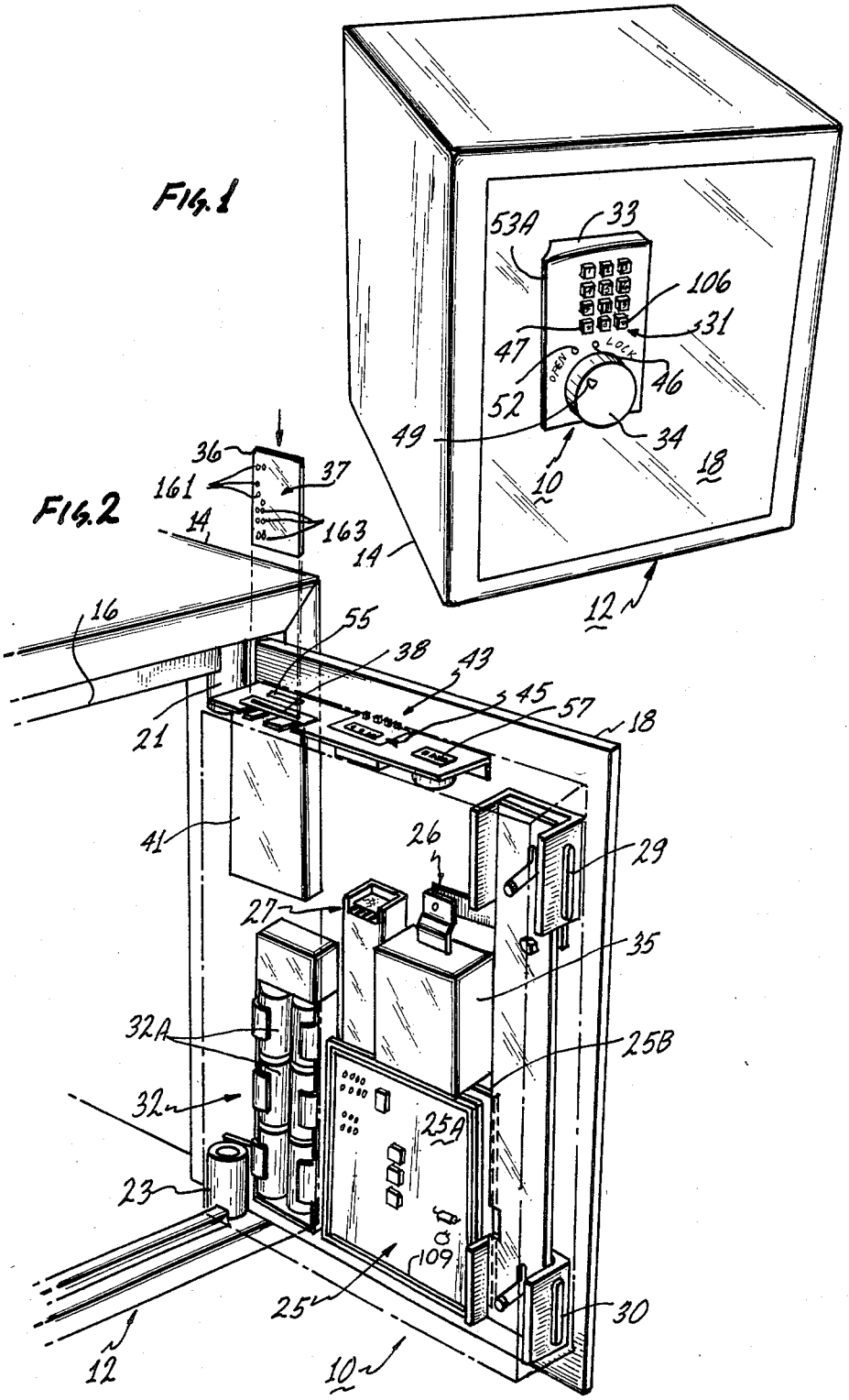
FIG. 1 is a pictorial view of an electrically controlled locking apparatus, which is constructed in accordance with the present invention, and which is shown incorporated in a door of a safe.
FIG. 2 is an enlarged, fragmentary pictorial view of the portion of the electrically controlled locking apparatus mounted on the rear side of the safe door, which is illustrated in its opened position.

Referring now to FIGS. 1 and 2, there is shown an electrically controlled locking apparatus 10, which is constructed according to the present invention, and which is incorporated in an "in-room" hotel or motel safe 12. While the locking apparatus 10 is shown and described to be incorporated into and forming a part of the safe 12, it will become apparent to those skilled in the art that the locking apparatus 10 is designed for multiple modes of operation, such as personal use safes, coin operation and multi-user applications. In general, the apparatus 10 may be employed for locking many different types and kinds of protected areas, such as doors of buildings, safes, vaults, and the like. The multi-user mode of operation is shown and described more completely in co-pending U.S. commonly-assigned patent application Ser. No. 716,331.

The safe 12 generally comprises a box or enclosure 14 having a front vertical door access opening 16 (FIG. 2). A vertically-disposed door or closure panel 18 is hingedly mounted at the right side of the front opening 16 at pivot points 21 and 23, to swing about a vertical axis between an opened position as shown in FIG. 2, and a closed position as shown in FIG. 1.

The electronic locking device 10 generally comprises a control circuit 25 embodied in a printed circuit board 25A, mounted on the back side of the door 18, for activating, through a linkage mechanism 26 and a solenoid 27, to cause a pair of reciprocating locking bars or bolts 29 and 30, to move selectively into or out of engagement with a pair of respective recesses or openings (not shown) at the side of the front opening 16 of the box 12 when the door 18 is closed. A telephone like key pad 31 mounted on a face plate 33 on the front of the door 18, enables an access code to be supplied to the circuit 25 by a user, to cause the bolt to be retracted permitting access to the interior of the box 14. A battery power supply arrangement 32, including batteries 32A, provides an alternate electrical power source for the apparatus 10, as hereinafter described in greater detail.

According to the present invention, the electrically controlled locking apparatus 10 includes a mechanical combination lock 35 mounted on the back side of the door 18 and activated by a knob 34 rotatably mounted on the face plate 33 at the front side of the door 18. For a more detailed description of the mechanical lock assist arrangement, including the linkage mechanism 26 and the lock 35, reference may be made to a co-pending U.S. commonly-assigned patent application Ser. No. 716,331.

As more fully described in the aforementioned co-pending U.S. patent application, the door 12 can be unlocked either by entering an access code into the key pad 31 for the control circuit 25, or by rotating the knob 34 for activating the mechanical lock 35. Ordinarily, different access codes may be employed for the control circuit 25 and the mechanical combination lock 35.

In order to program a desired personal access code in the control circuit 25 for enabling the door to be released, a user authorization card 36 bearing coded user authorization information generally indicated at 37, is first inserted manually into a slot 38 of a card reader 41, mounted on the back of the door 18. In response thereto, the circuit 25 can determine that the user is authorized and then prepares for an initialization operation, during which an authorized user is permitted to store his or her own personal access code in the control circuit 25.

A digitally encodable electrical input device 43, in the nature of "display switches", has a digital read-out display 45, and enables a devised four digit personal access code to be entered manually therein and stored in a non-volatile manner. The device 43 comprises a series, such as four or six conventional binary coded decimal mechanical encoders 50–53 (FIG. 6), which may be purchased from EECO Company, located in Anaheim, Calif. Thus, encoders serve as a non-volatile device for storing the access code, and for displaying the code visually on the protected inside of the door, or controlled access compartment (not shown).

Once the new four digit access code is arranged in the display switch array, the door can be released thereafter under electronic control, by entering that same four digit code into the key pad. The display 45 disposed in the protected area behind the door 18, permits an authorized user, after opening the door 18 by means of the knob 34 and the mechanical lock 5, to read the code from the display 45. Thus, should the user not remember the access code, the door can be released by means of the mechanical lock 35, and thus the access code for the control circuit 25 can be learned by an authorized person opening the door and observing the code indicated by the display 45.

General Safe Operation

Considering now the operation of the locking apparatus 10, assume that the safe 12 is located in a hotel or motel room. When a guest checks into the hotel or motel, and desires to make use of the safe 12, the guest is given the authorization card 36.

Upon entering the room, the guest first initializes the apparatus 10. Prior to the initialization procedure, both lamps 46 and 52 are extinguished.

The initialization procedure may be commenced by an "OPEN" push button key 47 of the key pad 31, being depressed by the user to open the safe. Thereafter, the knob is rotated to cause an arrow indicator indicia 49 on the face thereof to be moved to the position as illustrated in FIG. 1, to a position opposite an indicator lamp 52 in the OPEN position. In so doing, the indicator lamp 52 becomes illuminated in a flashing mode.

The safe door 18 is then unlocked whereby the fingers of the user can grasp a recessed handle portion 53A of the plate 33 on the left side thereof, to enable the door to be swung to the opened position as shown in FIG. 2.

As shown in FIG. 2, an indicator panel 55 becomes illuminated to designate the message "INSERT CARD". This message invites the user to insert the card through the slot 38 into the card reader 41. In so doing, the authorization information 37 is read from the card and signals indicative thereof are transferred to the control circuit 25, which then determines whether the authorization code is legitimate for this safe 12.

Once the card has been accepted, a message panel 57 on the back of the door 18 flashes a message "SET CODE". The user then enters his or her own personal access code, by manipulating the digital input device 43 to cause the desired four digit code to appear on the display panel 45. Thereafter, the door is closed, and the knob is turned to the "LOCK" position. At this point, the "OPEN" indicator 52 continues to flash. The code is then verified by entering the desired number in the key pad on the front of the door, so that the circuit 25 can determine that a match has occurred and prove operator proficiency.

Once the user verifies the new access code by use of the key pad 31, the "LOCK" indicator 46 is illuminated with a constant illumination. In this manner, the user can lock his or her valuables within the safe 12. If the user closes the door, moves the handle to the lock position and fails to enter the correct code through the keyboard within two minutes, the unit will "lock" automatically, indicated by indicator 46 illuminating in a constant manner.

In order to open the safe 12, and thus to gain access to it, the proper access code must first be entered into the key pad 31. Thereafter, the knob 34 is rotated counterclockwise from the "LOCK" position to the "OPEN" position. In this manner, the door can be opened.

Upon checkout of the guest from the hotel or motel, the door must be opened and then the card 36 withdrawn from the card reader 41. In this regard, when the card is withdrawn, the control circuit is prepared for the next user and causes the safe to become unlockable, until the proper card is again inserted into the card reader. Therefore, the guest can return the card to the check-out desk so that the safe 12 can be used by the next guest for that room.

Should the user, at any time, forget the access code, hotel personnel can release the door by using the mechanical lock 35. In this regard, a set screw (not shown) on the bottom of the knob 34, can be loosened and the knob then pulled axially outwardly a short distance. Thereafter, the knob 34 can be rotated about its axis in either direction, to enable the door 18 to be released. The guest may then be charged a fee for the necessity of such a service. Once the door is released, the access code can be readily observed from the display panel 45.

Should the guest check out and forget to bring the card to the desk, hotel personnel must open the door by means of the mechanical lock 35. For a more detailed explanation of the technique for unlocking the door by means of the mechanical lock, reference may be made to the aforementioned co-pending U.S. patent application.

Control Circuit

Figures 3, 4, 5, 6, 7, 8, 9:
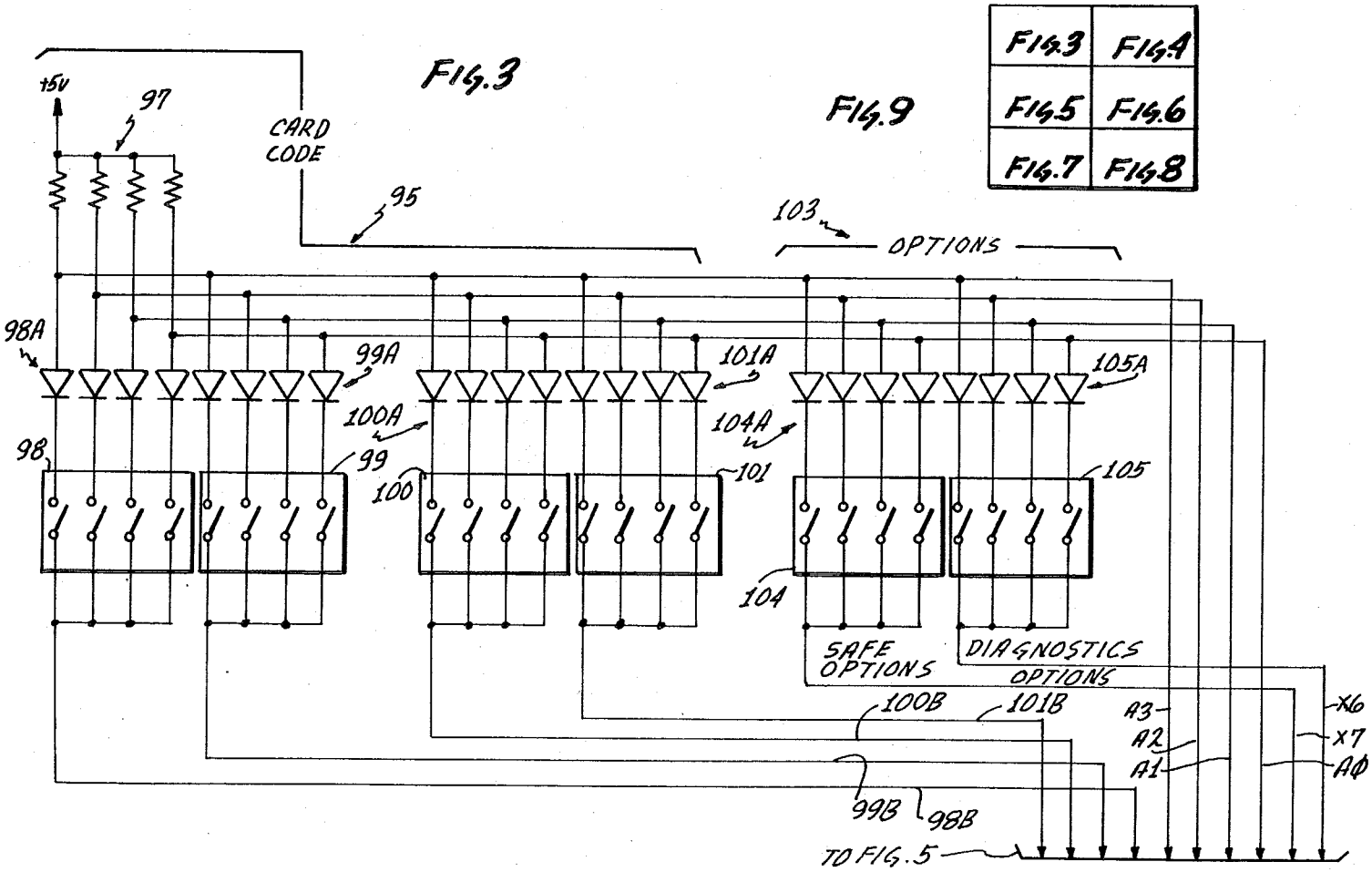
FIGS. 3–8, when arranged as shown in FIG. 9, comprise a schematic circuit diagram of the control circuit for the electrically controlled locking apparatus of FIG. 1.
Figure 4:
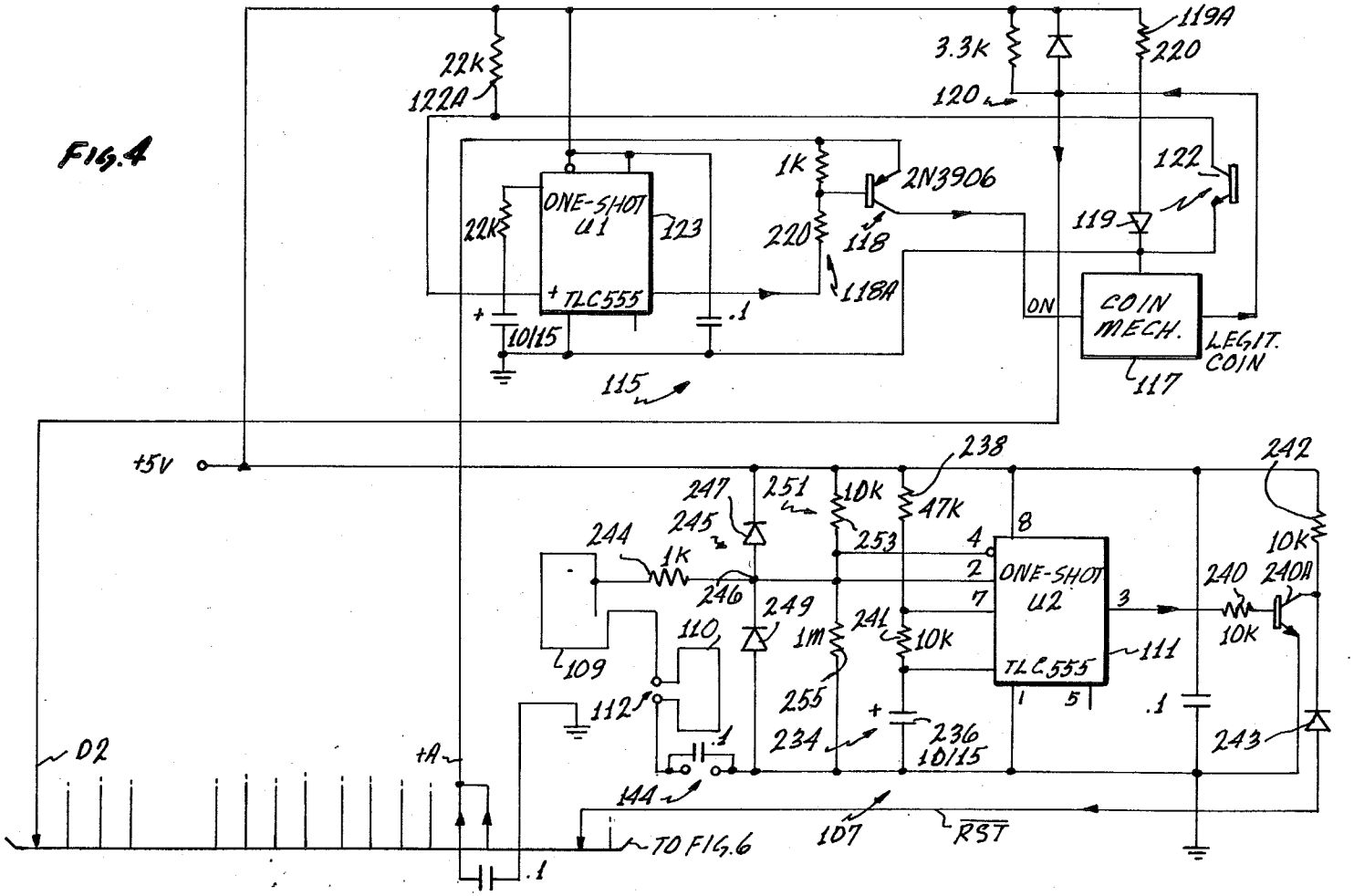
Figure 5:
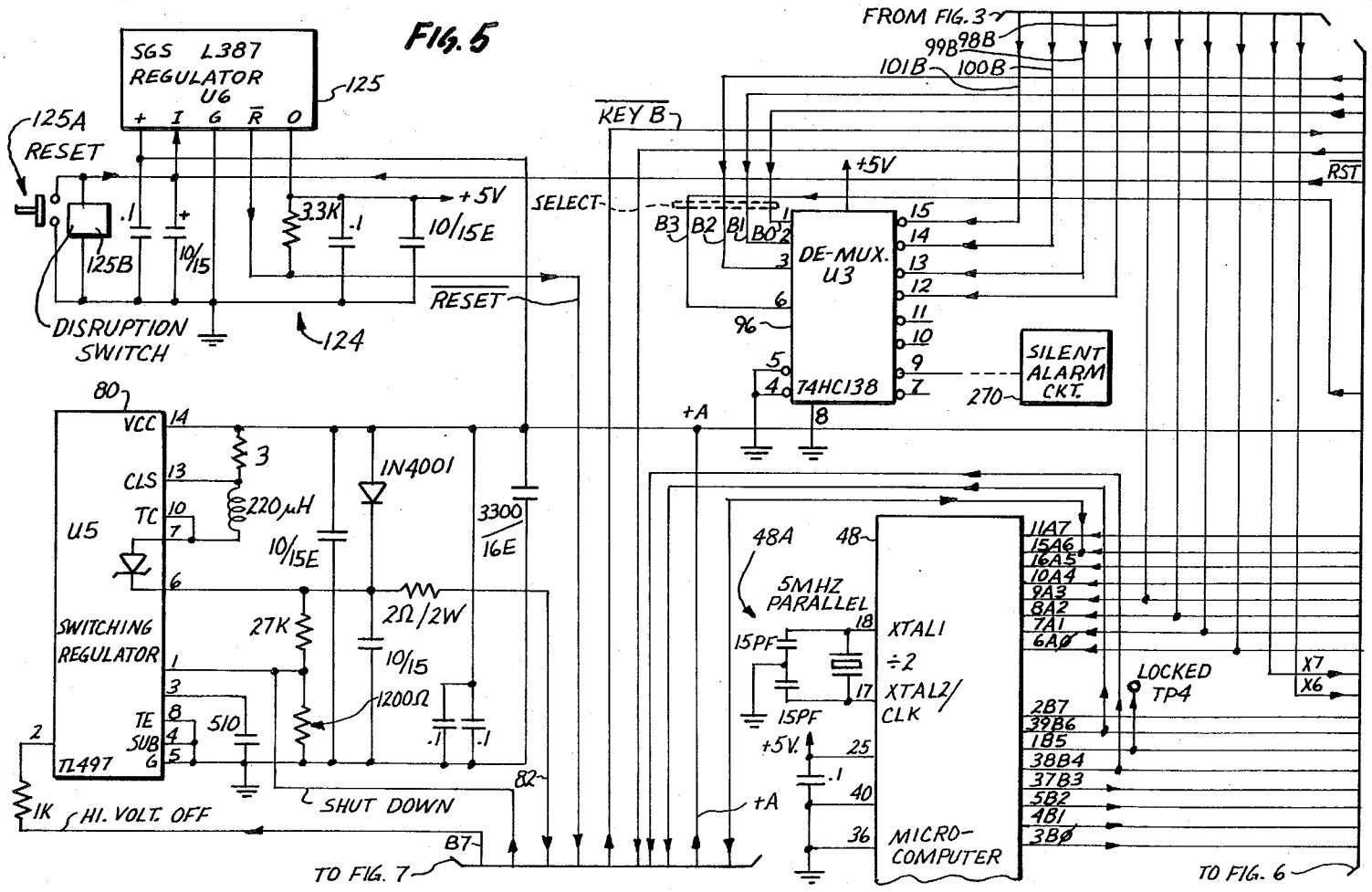
Figure 6:
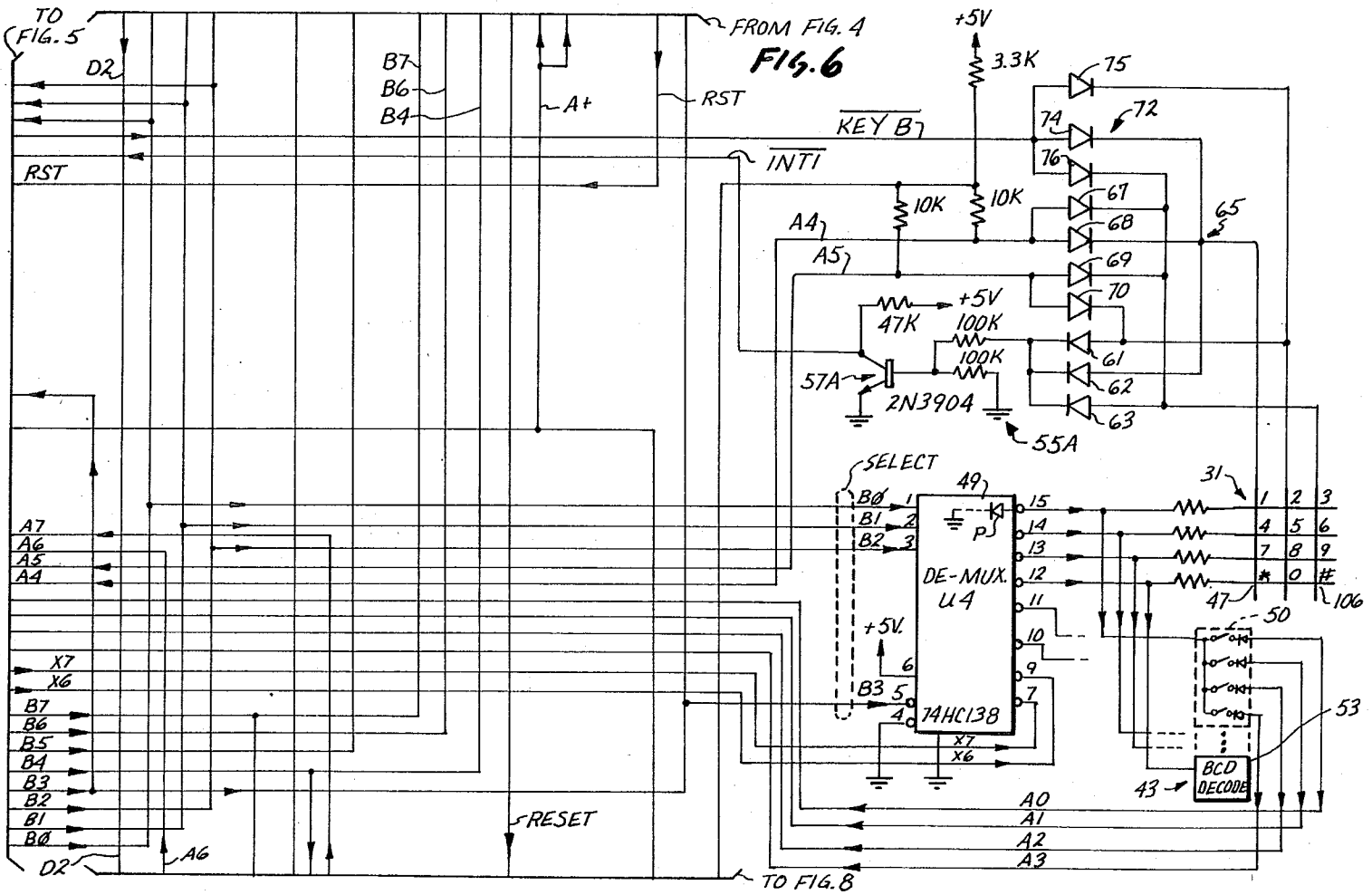
Figure 7:
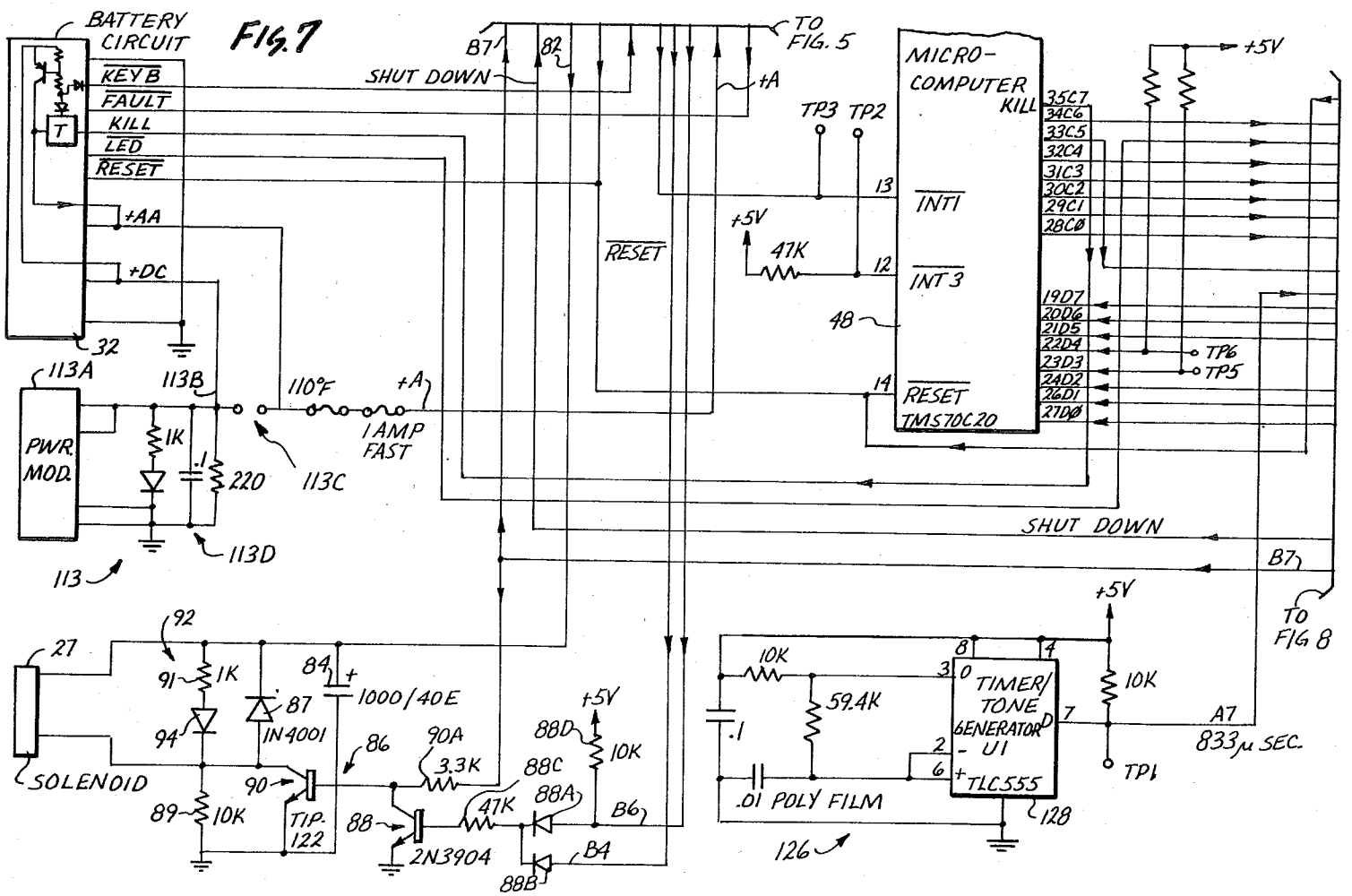
Figure 8:
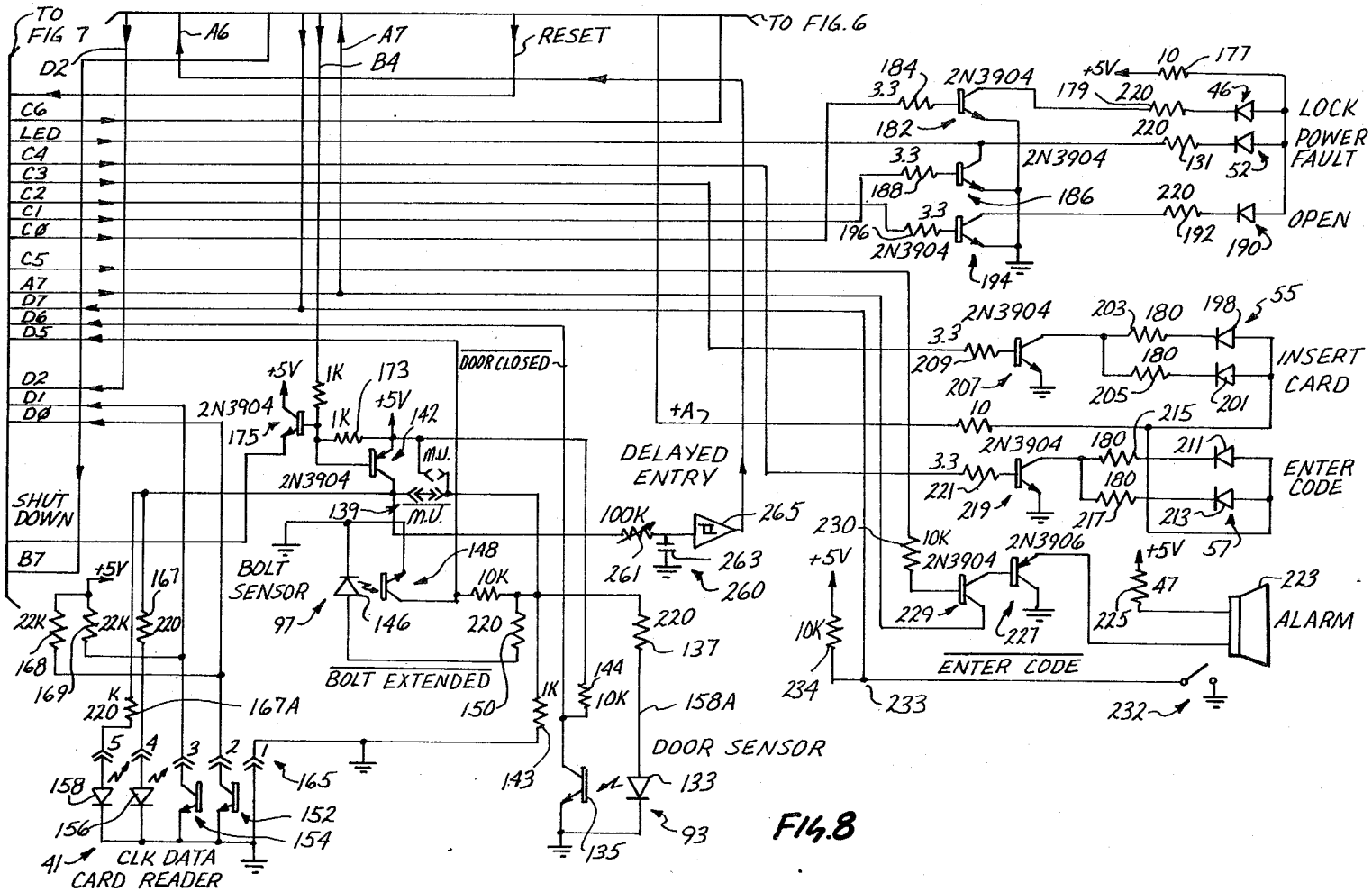

Referring now to FIGS. 3 through 8, as arranged in FIG. 9, a micro-computer 48, as shown in FIGS. 5 and 7, is used to control the operation of the apparatus 10. As shown in FIG. 6, a de-multiplexer 49A responds to select signals from the micro-computer 48 to monitor continuously an interrupt decoding circuit 55, which detects the pressing of a key of the key pad 31. The circuit 55A includes a transistor 57A and a set of three diodes 61, 62 and 63 for generating a signal INT 1' to supply it to a terminal 13 for the microcomputer 48 (FIG. 7). In this manner, an interrupt is provided to the micro-computer 48, indicating that one of the keys of the key pad 31 had been depressed.

A set of four binary-coded-decimal switch devices 50 through 53 of the input device 43 read the access code stored therein. This information is then transferred to the micro-computer 48, as A0–A3.

Upon receiving an interrupt, the micro-computer sends a coded select signal B0–B3 to activate the de-multiplexer 49 to interrogate each row of the keyboard. Each row is checked for a key push. If a key is pushed, a column code is returned through a circuit 65 including encoding diodes 67–70 for supplying coded signals A4 and A5 for encoding the column identity. In this regard, each row of the key pad matrix is selectively interrogated by the computer through the de-multiplexer 49, and the signals A4 and A5 identify which one of the three switches may have been depressed, if any. In turn, each one of the remaining rows is energized, and the sensing circuit 65 determines which one of the twelve switches was closed.

In the absence of a functional AC power converter, a power up circuit 72 (FIG. 6) detects the presence of the key of the key pad 31 being depressed, to in turn, generate a signal KEY B', which is transferred to the battery circuit arrangement 32 (FIG. 7) for causing it to generate a full supply voltage, +A, for the apparatus 10. In this manner, the battery circuit arrangement is not generally supplying energy until the key pad 31 is activated in the absence of AC power. In this regard, only a low current signal KEY B' is needed to turn on the battery circuit 78.

Referring to FIG. 9A, the batter circuit 32 controls the supply of the power signal +AA, which becomes power signal +A (FIG. 7) for the control circuit, and includes a timer 32B for switching off the power signal +A after a predetermined time delay interval, such as five minutes, to prevent unnecessary and unwanted drain on the batteries 32A, when the system is not in use. In this regard, the micro-computer 48 of the control circuit is functionally in an idle state, until a key of the key pad 31 (FIG. 6) is pressed. Once any key is pressed, a ground potential is supplied internally from the de-multiplexer 49 (FIG. 6) through the closed key switch and diodes 72 (FIG. 6) to supply the signal KEY B' to the battery circuit 32 of FIG. 9A. The signal KEY B' causes the time 32B to start running and to cause the generation of the signal +AA for so long as the timer 32B runs. If desired, under software control, a signal KILL generated by the micro-computer 48 can be supplied directly to the timer 32B for de-activating it prematurely to cause the early termination of the signals +AA and +A.

A transistor 32C conducts in response to the ground signal KEY B' being supplied through a suitably poled diode 32D, a point 32E and a resistor 32F to the base of the transistor 32C, a resistor 32K being connected between the emitter and the base of the transistor 32C. By so conducting, a current flow path is established from either the source +DC or the batteries 32A through respective diodes 32G and 32H, the emitter-base junction of the transistor 32C to an input to the timer 32B for starting it to run. In this regard, the current flow path established through the transistor 32C to the timer 32B, causes the timing interval to commence.

When the timer 32B becomes so activated, a lead 32J connected between point 32E and a RUN' input to the timer 32B is extended to ground potential at the grounded terminal 32H of the timer 32B, as indicated by the broken line shown within the timer.

Thus, should a key be depressed only momentarily, or should a "contact bounce" of the key occur, the ground signal KEY B' would be removed, at least temporarily. However, the power signals +AA and +A remain on, since the alternative path for the base of the transistor 32C maintains the transistor 32C conductive until the timer times out.

As shown in FIG. 5, a switching regulator 80 is used to provide a high-voltage signal via a lead 82 to a capacitor 84 (FIG. 7) to perform an unlocking operation to release the safe door. In this regard, in order to avoid having an externally applied high-voltage signal release the door by an unauthorized person, and otherwise to prevent an unauthorized access to the safe, the door can only be released during a certain window of time when a sufficiently high voltage has been internally generated and other conditions have been met. Thus, theft and natural occurrences, such as lightening, are prevented, or at least greatly inhibited from inadvertently releasing the safe door. Moreover, various checks on the control circuit 25 must be met and continue through successful completion of the entire window.

A switching circuit 86 (FIG. 7) includes a pair of cascaded transistors 88 and 90. Transistor 88 is rendered conductive by means of the presence of either one of signals B4 or B6, from the micro-computer 48. In the condition wherein transistor 88 is non-conductive, transistor 90 is rendered conductive under the control of a signal B7 from the micro-computer through a resistor 90A connected to the junction between the base of the transistor 90 and the collector of the transistor 88. Once the capacitor 84 has charged fully, the micro-computer turns on the switching circuit 86 via a current supplied by resistor 90A and not inhibited by a pair of suitable poled diodes 88A and 88B, through a resistor 88C to the base of the transistor 88, to render the transistors 88 non-conductive and 90 conductive. Therefore, the capacitor 84 then discharges through the solenoid 27 for activating it. Further false operation protection is provided by resistor 88D in generating an inhibit current (through diode 88A, resistor 88C, conducting transistor 88, inhibiting transistor 90) should an unknown state be caused by a failed micro-computer 48.

A capacitor discharge path from the + side of the capacitor 84 through the solenoid 27 and the collector-emitter junction of the transistor 90 is provided to ground. In this manner, the solenoid 27 is initially activated to release the safe door by the required high voltage, when the capacitor 84 is charged. After the solenoid is activated, it remains energized by means of a lower holding current flow via lead 82 from the switching regulator 80 (FIG. 5).

It should be noted that if the signals B4 and B6 are for whatever reason not inhibited, the charge on the capacitor 84 is discharged quickly through a capacitor bleed circuit 92, the solenoid, and an LED indicating diode 94, a resistor 91, and a resistor 89. A suitably poled diode 87 is connected between the collector of the transistor 90 and the lead 82 to dampen all inductive ringing and prolong long life of transistor 90.

As shown in FIG. 8, the door sensor circuit 93 determines that the door 18 has been closed, to supply a signal D6 (DOOR') to the micro-computer 48 to indicate that the door, in fact, is closed. It is important to indicate to the user that the door has, in fact, been properly closed, and thus locked. Otherwise, the door may be left ajar, and thus the stored valuables are not protected and thus the user should lock the safe.

In this regard, in a similar manner, as shown in FIG. 8, a bolt sensor 97 also detects that the bolts for the locking mechanism are properly moved into position for locking the safe door. Only after the door has been properly closed and bolted, is the LOCK signal transmitted to the LED indicator 46 (FIG. 8).

As shown in FIG. 3, a card code identity circuit 95 stores the card code which corresponds to the coded information 37 on the card 36 (FIG. 2). A de-multiplexer 96 (FIG. 5) interrogates the card code identity circuit 95 under the control of select signals B0 through B3 supplied to the de-multiplexer 96, from the micro-computer 48.

As shown in FIG. 3, the circuit 95 includes a set of four groups 98–101 of manually operable DIP switches. Each one of the groups, such as the group 98, includes four switches. In this manner, a four digit binary-coded-hexidecimal code can be set into the DIP switches to match the coded information 37 on the card 36. Each group of switches is connected individually via diodes to one of the signals A0 through A3 supplied to the micro-computer 48.

Four groups of suitably-poled diodes 98A, 99A, 100A and 101A are connected individually between the four groups of DIP switches 98–101, respectively, and a group 97 of four pull-up resistors, which are connected each to +5 volts. The signal leads A0 through A3 to the micro-computer are connected to individual ones of the diodes in each group of diodes, at a point between the respective ones of the diodes of a group and an individual one of the resistors of the group 97. In this manner, the coded potentials on the leads A0–A3 can be sensed by the micro-computer 48 (FIG. 5).

The switches in each one of the groups 98–101 are connected together to an individual respective lead 98B–101B, which in turn, are connected to the de-multiplexer 96 of FIG. 5. In this manner, the de-multiplexer 96 supplies ground potential to individual ones of the leads 98B–101B selectively, for designating individual ones of the groups 98–101 of the switches.

Once a group is selected by one of the leads 98B–101B, then the micro-computer, via each one of the four leads A0–A3, senses the potential at each one of the four diodes connected to the four switches of the designated group. If a switch is closed (not shown), a ground potential is supplied to the corresponding one of the leads A0–A3. If the switch is opened, as shown, a group 97 resistor pulls the line up and +5 volts is detected. Thus, the state of the switches 98–101 can be sensed to determine the card identity code.

As shown in FIG. 3, a set of option circuits 103, comprising a safe option group 104 of manually operable DIP switches and a diagnostics group 105 of manually-operable DIP switches, are interrogated in a similar manner as the card code circuit 95. In this regard, a group 104A of four suitably-poled diodes, are connected between respective ones of the four DIP switches of the group 104, and the respective ones of the group 97 of four resistors, as well as to the signal leads A0–A3 to the micro-computer 48. The other terminals of the switches of the group are connected together to a signal lead X7 for the de-multiplexer 49 (FIG. 6), which serves a similar selecting function as the de-multiplexer 96 (FIG. 5) for the card code circuits 95.

In this manner, since the safe code switches 104 are connected via a single lead X7 to the de-multiplexer 49

(FIG. 6), each individual switch can be interrogated by means of the same select signals A0 through A3 from the micro-computer 48. The four switches 104 provide 16 option codes, representing different types of safe arrangements. In this regard, the option code fifteen identifies the safe to be a four digit input code device 43. The code one represents a high-security arrangement of a five digit access code, comprising four numerical digits followed by pressing of the # (OPEN) key 106 (FIGS. 1 and 6) of the key pad 31 to open the safe electronically. The option code three represents a four digit access code, which is settable by the keypad instead of the decimal display input device, such as the "thumbwheel" (FIG. 2). Similarly, the option code four represents a six digit access code, set by means of the keypad. In the latter two keypad settable access code situations, the new access code must be entered twice, firstly to set the code and secondly to verify the new code. Other option codes are not herein defined as being unnecessary to the proper understanding of the system.

The remaining option switches 103 comprise the diagnostics option group of switches 105, which operate in a similar manner as the safe option switches 104, and which provide diagnostic codes to cause information for the micro-computer 48, to function in a diagnostic mode for trouble shooting purposes. In this regard, the switches 105 can be set selectively during a diagnostic or trouble-shooting operation, should a malfunction occur.

The four manually-operable dip switches of the group 105 are connected together at one of their terminals to a signal lead X6 for the de-multiplexer 49 (FIG. 6). Their other terminals are each connected respectively to an individual one of a set 105 of four suitably-poled diodes, which in turn, are connected to the resistors 97 and the signal leads A0–A3 of the micro-computer 48 in a similar manner as the diode group 104A.

Referring now to FIG. 4, there is shown a static voltage detection circuit 107 which prevents the control circuit 25 from responding to externally applied high voltage or other spurient discharges, such as lightening strikes, which could otherwise cause the control and unwanted circuit 25 to release the safe door in an undesirable manner. In this regard, unauthorized persons attempting to open the safe could attempt to use an externally applied, high voltage source to disable the control circuit in an attempt to release the safe door. A similar situation could occur by a lightening strike.

In order to prevent such unwanted occurrences from possibly causing the control circuit 25 to release the door, a loop conductor 109 (FIGS. 1 and 4) extends about the periphery of the outer printed circuit board 25A, shown in FIG. 1, to provide a magnetic coupling to sense such unwanted discharges. Similarly, an antenna loop 110 (FIG. 4) is electrically connected in series with the loop 109 by being connected across a pair of terminals 112, to provide an electrostatic sensitivity. In this regard, if desired, the loop 110 may be employed by connecting it electrically to the terminal 112, positioned at the back side of the safe door. It should be noted that a pair of terminals 114 are connected in series with the loops 109 and 110 and are allowed to be in an opened circuit condition as shown in FIG. 4 when the antenna loop 110 is employed, because the electrostatic loop 110 does not require a closed current path to operate. When it is not employed, the terminals 112 and 114 are short circuited with suitable jumpers (not shown), to provide a current flow path.

When the loops detect spurious discharges, a one-shot circuit 111 causes a RESET signal to be generated for a suitable interval of time, such as about 5 seconds. The reset signal RST' is transferred to the micro-computer 48 to cause it to commence a power-up cycle of operation and thus the control circuit 25 does not function for the length of time required for a power-up cycle of operation. In this manner, the disturbance is allowed to settle down, before the control circuit is able to commence further operation. If the disturbance is not a naturally occurring one and is still present, such a disturbance will continuously cause the circuit 25 to re-enter its power-up cycle of operation, until the disturbance ceases to be present.

As shown in FIG. 7, a power circuit 113 includes a power module 113A, which converts AC power to DC power. In this regard, the power module 113A is adapted to be plugged into an external line socket for providing constant 9 volt DC power for components of the control circuit 25. An output lead 113B is connected from a filter and voltage conditioning circuit 113D, to the battery circuit 78, which in turn, provides an output +AA, to in turn, provide the positive voltage +A for the control circuit.

In the event of a power failure, or if an unauthorized person cuts the power supply cord (not shown) of the power module 113A, the battery circuit 78 continues to provide the necessary voltage +A. Should the battery circuit 32 not be used, a terminal 113C is short circuited by means of a suitable jumper conductor (not shown).

Referring now to FIG. 4, a coin detection circuit arrangement 115 is employed, when the safe is to be used in public locations so that the user is permitted to use the safe by first inserting a predetermined number of coins (not shown) into the arrangement 115. The circuit arrangement 115 includes a conventional coin mechanism module 117, which compares the coins being inserted with standard coins (not shown) mounted therein according to known techniques.

In order to conserve energy, power is supplied to the coin mechanism module 117, only when coins are inserted into the arrangement 115. For this purpose, a light emitting diode 119 is connected between an input to the coin mechanism module 117 and +5 volts via a resistor 119A, and a phototransistor 122 is connected between the module 117 and +5 volts, via a resistor 122A. The phototransistor 122 detects the presence of each coin as it interrupts the light path between the diode 119 and the phototransistor 122, which in turn, energizes a one-shot circuit 123 to generate a predetermined pulse, such as a 500 milli-second pulse.

As a result, a signal from the one-shot circuit, via a voltage divider network 118A to the base of a transistor 118, causes it to saturate for turning ON the coin mechanism module 117. In this manner, the coin mechanism module 117 is only energized for a sufficient length of time to permit it to compare the coin being deposited with the standard coin. If it is a legitimate coin, a signal is generated and supplied to the micro-computer 48 via the signal lead D2. In this regard, the signal D2 is a ground signal each time a legitimate coin is detected and is otherwise at +5 volts potential, via a resistor-diode network 120.

Referring now to FIG. 5, there is shown a regulating circuit 124, which includes a regulator 125, which is a conventional line power voltage monitor. The regulator 125 generates the reset signal for the micro-computer 48 and the battery circuit 78. The regulator is interrupted by the signal RST from the static circuit 107 (FIG. 4), or by a manual reset switch 125A.

A disturbance switch 125B is connected across the reset switch 125A, and when closed, also causes the micro-computer 48 to be reset. The switch 125B may be a gravity type switch, for example, such as a mercury switch, a shaker switch, or the like.

Thus, should a disruption occur, the switch 125B closes to reset the micro-computer 48, and thus to prevent it from releasing the door 22 for a period of time for the micro-computer to sequence through its start-up operation. Therefore, a disturbance prevents the door from being released during a pre-determined time delay interval.

A disruption can be caused by mechanical abuse of the safe, an electrical power problem (e.g. disconnecting the power without batteries being used), subjecting the safe to extreme hot or cold temperatures, as well as temporary electronic failures, such as an electro-magnetic interference or other temporary electronic failure or malfunction.

As shown in FIG. 7, a timing circuit 126 having a timer 128, supplies timing signals via an A7 signal lead to the micro-computer 48, for the control circuit 25.

Considering now the micro-computer 48 in greater detail, with reference to FIGS. 5 and 7, the terminal designations are listed on the outside of the box adjacent to the signal identification. For example, "7A1" indicates that the signal A1 appears at terminal 7. At the right side of the box illustrating the micro-computer 48, there appears four sets of signals arranged in groups of input signals A and D, and in groups of output signals B and C.

At the left side of the box representing the micro-computer 48, are various interrupt and reset terminals. An external clock arrangement 48A is also provided at the left side of the micro-computer box. The designation for the micro-computer, as well as the other integrated circuits shown herein, are shown in the lower portion of the box, at the inside thereof, to identify the component.

Considering now the battery circuit 32 in greater detail with reference to FIG. 7, the signal KEY B' from the battery circuit, to the power up circuit 72 (FIG. 6) to low voltage via the protect diodes (not shown) in the de-multiplexer 49, for causing a small current flow, when a key of the key pad 31 (FIG. 6) is depressed. Once such a key is depressed, the battery circuit 32 generates its output voltage signal +AA in response to the small current flow. The signal +A is supplied through the fuse to become signal + which is supplied amongst other places, to the regulator 125 (FIG. 5.). The regulator 125 then commences a power-cycle of operation which requires predetermined time intervals before the door 22 can be released and the high voltage operation of the solenoid.

A signal FAULT is generated by the battery circuit when a power fault is detected in the power circuit 113 or in the battery circuit 78. In so doing, such a signal is supplied to the micro-computer 48 to indicate that the power is about to fail, and therefore the micro-computer enters into a safe mode of operation.

A signal KILL generated by the micro-computer 48 indicates to battery circuit 78 that the safe need not remain powered up due to inactivity. This signal is supplied to the battery circuit to cause a power-down mode. In this manner, the control circuit 25 is rendered idle after five minutes of inactivity if the unit electronics 25 is operating on batteries due to the power module 113A inoperability. A signal LED indicates that either the battery circuit or the power circuit 113 has caused a fault, and therefore the LED 52 (FIG. 8) is energized via a current limiting resistor 131.

A signal RESET' is generated by the battery circuit 78 to cause the micro-computer 48 to be reset if the battery circuit 78 detects a fault. A lead designated +DC is connected to the lead 113B of the power circuit 113.

Referring now to FIG. 8, the door sensor circuit 93 generally comprises an LED diode 133 for irradiating a phototransistor 135, whereby the pair of devices are mounted on the door so that when the door is closed, the door provides a reflective surface to complete the light path between the two devices. The diode 133 is energized by a ground signal at lead B4 from the micro-computer and a +5 volts extended from the transistor 142, through to a jumper 139, and a resistor 137. It should be noted that the jumper 139 is provided when the multi-user mode of operation is not employed, a jumper 144 being employed when the multi-user system is the mode of operation desired.

In order to bias the phototransistor 135, a resistor 144 is connected between the collector of the transistor 135 and +5 volts. The DOOR CLOSED' signal is supplied to the lead D6 to the micro-computer 48. A resistor 143 is connected between the upper end of the resistor 137 and ground, for assured voltage levels on the collector of transistor 142.

Considering now the bolt sensor circuit 97, with reference to FIG. 8, the circuit 97 generally comprises an LED diode 146, which emits light to a phototransistor 148. The diode 146 is suitably poled and is connected between ground and the collector of transistor 142 through resistor 150 which is also controlled by the lead B4 of the micro-computer 48 as was the door sensor. The phototransistor 148 then supplies the D5 signal BOLT' to the micro-computer 48.

Considering now the card reader 41 of FIG. 8, there is provided a pair of phototransistors 152 and 154 which sense light emitted from a pair of LED diodes 156 and 158 respectively. In this regard, the phototransistor 154 detects the pattern of holes 161 (FIG. 2) arranged in a row in the card 36 to serve as the data portion of the coded information 37. Similarly, the phototransistor 154 is lined with a row of clock holes 163 in the card 36 to form a portion of the information 37, to enable the data information received from the data holes 161 to be synchronized.

A connector 165 (FIG. 8) enables the phototransistors and the LED diodes to be removed from the circuit 25, when a card reader and a card are not used with the safe. In this regard, the following is a table to show how the terminals 1, 2 and 3 of the jack 165 can be jumpered to provide various additional modes of operation for the apparatus 10.

| Mode Of Operation | 1 | 2 | 3 |
|---|---|---|---|
| Coin | X | X | X |
| Personal | X | X | |
| Multi-user | X | | X |

The letter "X" indicates a terminal where a jumper is to be connected, and the numbers 1–3 refer to the like numbered designations for the connector terminals. The coin mode of operation is where the coin mechanism is employed. The personal mode of operation is where there is not card or coin mode of operation, and instead, the safe can be used in the home or other place by an owner/user. The multi-user mode of operation is a system where more than one user can operate the safe, and yet there is no card or coin mechanism employed.

When used as shown as a card reader, the diodes 156 and 158 are suitably poled and are connected between ground through resistors 167 and 167A, and the collector-emitter junction of the transistor 142 to +5 volts. The transistor 142 is operated by the B4 signal from the micro-computer 48.

In order to bias the phototransistors 152 and 154, their emitters are grounded, and their collectors are connected respectively through resistors 168 and 169 to +5 volts. The collectors are also connected directly to the micro-computer 48 to supply respective signals Data D0 and Clock D1 information.

In order to save energy, by the provision of intermittent current flow to the door sensor, bolt sensor and card reader, the transistor 142 is rendered conductive by the micro-computer sending its signal B4 to render the transistor 142 conductive, only during appropriate portions of the operation of the control circuit 25. A bias shunt resistor 173 is connected between the emitter of the transistor 142 and the lead supplying the signal B4.

In order to remove the power from the switching regulator 80 (FIG. 5), a transistor 175 has its base connected to the lead supplying the signal B4 to supply a signal SHUT DOWN to the terminal 1 of the switching regulator 80 as shown in FIG. 5.

As shown in FIG. 8, the LED diode 46 is connected through a current limiting resistor 179 to a transistor 182, which serves as a switch for controlling the diode 46. A resistor 184 is connected between the base of the transistor 182 and the lead for conveying the signal C0 from the micro-computer 48 for saturating the transistor 182. In this regard, the diode 46 is connected between the resistor 179 through a resistor 177 to +5 volts, whereby when the signal C0 saturates the transistor 182, the diode 46 conducts from the +5 volts through the resistor 177, the diode 46, the resistor 179 through the emitter-base of the transistor 182, to ground. Resistor 177 is used as a current limiting device to protect all of the LEDS on the door front 33 (FIG. 1).

The diode 52 is connected to the lead supplying the signal LED', but also it can be rendered conductive by means of a switching transistor 186, which has its base connected through a resistor 188 to the lead supplying the signal C1 from the micro-computer 48.

Similarly, an indicating LED diode 190 is rendered conductive by being connected through a resistor 192 to a switching transistor 194, which has its base connected through a resistor 196 to the lead supplying the signal C2 from the micro-computer 48.

The indicator panel 55 is illuminated by a pair of LED diodes 198 and 201, which are connected through respective current limiting resistors 203 and 205 to the collector of a switching transistor 207. A resistor 209 connects the base of the transistor 207 to the lead supplying the signal C3 from the micro-computer 48. In a similar manner, a pair of LED diodes 211 and 213 illuminate the message panel 57 through a pair of resistors 215 and 217 to a collector of a transistor 219, which has its base connected through a resistor 221 to the lead supplying the signal C4 from the micro-computer 48.

To facilitate the operation of the safe, an alarm speaker 223 provides beep signals at appropriate times during the operation of the system. The speaker 223 is connected through a resistor 225 to +5 volts, and has its other terminal connected to a pair of cascaded switching transistors 227 and 229. The base of the transistor 229 is connected through a resistor 230 to a lead supplying the control signal C5 from the micro-computer 48. The emitter of the transistor 229 is connected to the lead supplying the signal from timer/tone circuit 126 (FIG. 7), timer chip 128. As an optional feature, a manual switch 232 is connected to a lead supplying the signal D7 to the micro-computer 48. A junction point 233 between the switch 232 and the the signal D7, is connected through a resistor 234 to +5 volts, whereby when the switch 232 is closed, the point 233 is switched from +5 volts to ground, to provide the signal on the lead D7.

Referring now to FIG. 4, the static circuit 107 includes a timing circuit 234 comprising a timing capacitor 236 and resistors 238 and 241 for controlling the input of the one-shot circuit 111. In this regard, the timing circuit 234 detects the signal detected by the loops 109 and 110 to provide for the initiation of the one-shot circuit 111 to provide a long pulse, which in turn generates the signal RST'. In this regard, the timing circuit 234 determines the one second interval for the signal RST'.

The output terminal 3 of the one-shot circuit 111 is connected to a resistor 240 connected to the base of transistor 240A, whose collector is connected between a current pull-up resistor 242 and a suitably-poled diode 243, which supplies the signal RST' to the regulator 125 (FIG. 5).

A current limiting resistor 244 is connected in series between the loop 109 and a point 246 between a pair of diodes 247 and 249 of a high-voltage protection circuit 245, which is, in turn, connected between +5 volts, and the terminal 114.

A balancing circuit 251 comprising a resistor 253 connecting in series with a resistor 255 is connected between +5 volts and ground. The balancing circuit 251 is connected as shown to the one-shot circuit 111.

Computer Software Control

Figures 10A, 10B, 10C:
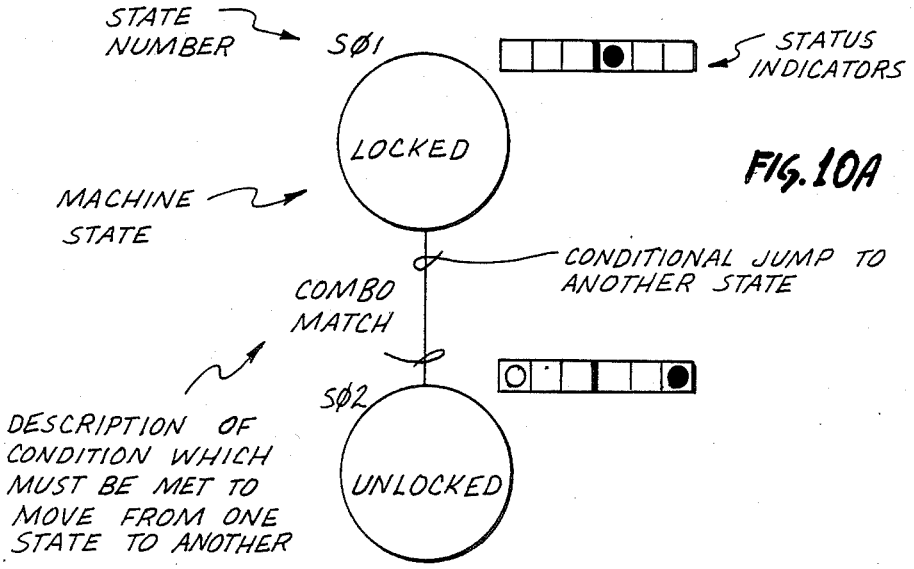
FIGS. 10A, 10B and 10C are diagrams useful in helping to understand the symbolism used in the flow chart diagram of FIG. 10.

Referring now to FIGS. 10, 10A, 10B and 10C, there is shown a detailed flow chart of a computer software program stored in the micro-computer 48 (FIGS. 5 and 7) for controlling the operation of the control circuit 25. FIGS. 10A, 10B and 10C explain the symbolism used in the flow chart of FIG. 10.

Assuming an initial state of operation prior to connecting power to the control circuit 25, a POWER ON state S00P is entered once the battery circuit 32 becomes energized by inserting the batteries 32A therein, or alternatively, the power module 113 is connected to a suitable source of alternating current. In such a state, the red indicator 52 becomes illuminated. Thereafter, the initialization state S00I is entered. This state is a transitional state, and it will be assumed that the card 37 has not been inserted into the card reader. Thus, a transition occurs to state S01, which is a solenoid OFF or "waiting" state. It should be noted that if the card has already been in place or a personal mode is employed (no card reader is used), a transition occurs to a RESET TRIES state S08, which will be hereinafter explained in greater detail.

Once the state S01 is entered, any key depressed on the key pad 31 will cause the safe door 18 to be released. Once any key is so depressed, the lamp 52 blinks, and the OPEN state S02 is entered. If within a predetermined time interval of three seconds, a person turns the knob 34 from the LOCK position to the OPEN position, as illustrated in FIG. 1, the locking bolts 29 and 30 are retracted to cause the transition to the state S01. Once the door is opened or the bolts are retracted, a transition occurs to the state S03.

In state S03, the INSERT CARD PLEASE display is energized and is caused to wink, for prompting the user to insert the card 37 into the card reader. Once the card is so inserted, a transition occurs to the state S03B. it should be noted that if the bolts are extended and the user desires to close the door during state S03, the bolts must first be retracted. In order to retract the bolts, any key on the key pad 31 can be pushed to cause a transition to occur to state S03C. In that state, the solenoid is energized for a period of three seconds so that the user can then turn the knob for retracting the bolts. In so doing, a transition occurs to the state S03.

Once in state S03B, the card is read. If the code contained in the card does not match the predetermined code programmed in the micro-computer 48, a transition occurs back to state S03.

However, it will be assumed that the code is proper, and thus the card is authorized. In such a case, a transition occurs to the state S04. With such a transition, the OPEN indicator and the INSERT CARD display are illuminated in a winking mode, and the speaker alarm is sounded intermittently. In state S04, the user is thus invited to enter the code into the digital input device 43 ("thumbwheels"). Once the code is entered, the user must clarify the entering of the code by pressing corresponding keys on the key pad in the front of the door or push optional "code acknowledgement" push button 232 (FIG. 8). Once this has been accomplished a transition occurs to the READY TO LOCK state S06. As indicated in FIG. 9 there are other conditions which could cause such a transition. In this regard, a push button switch 232 (FIG. 8) (not shown on FIG. 2) could be closed following the entering of the code into the device 43, in place of requiring the user to enter the four digit code into the key pad. In the high security mode, the user must also press the LOCK key 47 following the entry of the access code to secure the unit.

Thereafter, the user closes the door and extends the bolts by turning the knob 34 to the LOCK position as shown in FIG. 1. In so doing, a transition occurs to state S07, thereby causing the LOCK indicator 46 to be illuminated in a steady manner. In this state, the safe is locked and the user has his or her valuables securely stored therein.

The LOCKED AND UNDISTURBED state S07 is a state where the safe is locked and no one has disturbed the unit by pressing any of the keys on the key pad. Once a key is pressed, a state S08C is entered and the green LOCK indicator 46 commences to flash. This flashing indicates that the safe has been disturbed, even though the safe remains locked. Therefore, if an unauthorized person has pressed any key, the indicator 46 will continue to flash so that when the authorized user returns, it will be apparent to the authorized user that someone has disturbed the safe and had attempted to open it in the user's absence.

The act of pushing any key on the key pad causes a transition to occur between the states S08C and S10, since the state S08C is merely a transitional state. During the state S10, the micro-computer 48 compares the access code entered in the key pad with the access code set in the device 43 or stored in the micro-computer 48.

Should the person attempting to open the safe try unsuccessfully more than fifteen key pushes (e.g. more than three 4-digit codes attempted), a transition occurs to state S09. The state S09 causes a lock out to occur for a predetermined lock out interval, such as fifteen minutes. During state S09, the LOCK indicator 46 blinks. Also, the key pad is not scanned, so that any further entering of information into the key pad is totally ineffectual. In this manner, an unauthorized person would be defeated in his or her trial and error attempts to open the safe.

At the end of the fifteen minute interval, a transition occurs to state S08 to reset the control circuit 25. In state S08, lockout tries are reset, and the state transitions to S08C, where it will reset until a new key is pushed and the control circuit 25 is re-established to enable a person to release the safe door by entering the correct access code.

In state S10, should the correct access code be entered, a transition occurs to state S11, which is a delayed entry mode of operation. In this regard, even though the correct code has been entered, the safe door 18 will not be released until the expiration of a time delay interval. Thus, if the authorized user is acting under duress, the authorized user can inform the person causing the duress that the delay is inherent in the operation, to discourage access to the safe by the unauthorized person. If the delay interval is less than thirty seconds, and if the correct combination or access code is entered into the key pad, a transition occurs to the OPEN state S05, whereby the bolts are released.

In order to program the delayed entry time delay interval, a delayed entry timing circuit 260 (FIG. 8) is controlled by the micro-computer. In this regard, under the control of the transistor switch 142 via the signal B4 from the micro-computer, when the signal B4 occurs, such transition causes a timing capacitor 263 to be charged via a current limiting timing resistor 261 for triggering a Schmidt trigger circuit 265, which has its output connected to the signal lead A6 for the micro-computer. Thus, the micro-computer 48 receives a delayed response of such transition, and in turn, terminates signal B4 (return to ground potential) for discharging the capacitor.

Once the capacitor discharges below a certain low threshold potential for turning off the Schmidt trigger, such Schmidt trigger transition causes the signal A6 to be terminated. In so doing, the micro-computer 48 responds thereto to again generate the signal B4.

The micro-computer 48 counts all of the transistions of the signal A6, until a predetermined number, such as a 1,000, has been reached. This determines the end of a time delay interval. Thus, the duration of such interval can be adjusted by adjusting the value of the resistor 261, which determines the R-C time constant.

In order to count to the first longer interval, the A6 transitions are counted twice to the preselected number to establish the first delayed entry interval. At the end of the first such interval, the delayed entry circuit 260 is caused to be energized by a second series of B4 transitions to count a third time to the preselected number to provide a second delayed entry time delay interval, which is half the duration of the first interval.

The delay intervals can be modified by adjusting the R-C time constant of the circuit 260 to change the first and second delay intervals. In this regard, by adjusting the time constant of the circuit 260, the length of time required to count to a certain number can be modified either upwardly or downwardly accordingly.

If the first delay interval is greater than thirty seconds, then the second delay time interval becomes effective. In this regard, assume the first time delay interval is one minute and the second time delay interval is one-half of the first time delay interval, or in this case, one-half of a minute, a transition from state S11 is made to the state S12, once the first time delay expires. The user then must input the correct access code into the key pad during the second time delay interval of one-half minute for the purpose of opening the door. If the user accomplishes the task satisfactorily, a transition occurs from state S12 to the OPEN state S05 for enabling the door to be opened.

Should the user not enter the correct access code during the next one-half minute comprising the second time delay interval, a time out occurs and a transition takes place from state S12 to the reset state S08, then a transition to state S08C takes place to continue the cycle of operation.

Once the door-opening state S05 is entered, the door can be opened by turning the knob and thus retract the bolts, within a three second interval. If such occurs, a transition to state S04 occurs. If the door is closed and the bolts are extended, a transition occurs from the state S04 to the state S07. It should be noted that in order to enter state S07, the safe must have been previously locked or there must have been no activity for a period of two minutes. This latter condition covers the possibility that the user inadvertently closes the door and is unable to verify his access code because he had not yet changed the prior user's access code to his personally selected access code, or, he could not recall (or confused) his new access code. The two minute delay provides an opportunity for the user to open the safe without an access code to either set or review his correct access code before the safe is truly locked.

Thus, once the state S07 is re-entered, the user can go through a simple series of operations to again reopen the safe any number of times. Once the user wishes to check out of the hotel and terminate his or her usage of the safe, the user enters the correct correct code (S05), opens the safe door (S04), and removes the card 37 (S03). The state S03 prompts the user to again re-insert the card. However, it is assumed that the user does not re-insert the card, but instead closes the safe door and extends the bolts by turning the knob. In so doing, a transition occurs to state S01, which is the "WAITING" state, to enable anyone to open the door by pressing any key on the key pad. In this manner, the next guest in the hotel or motel desiring to use the safe, can gain access to the safe by pressing any key and inserting the card, as previously described.

Additional modes of operation will now be considered. In order to initiate a silent alarm, when state S10 is entered, the user enters a first digit into the key pad which is equal to the correct number plus five. For example, if the correct first digit is a "2", the user would deliberately enter the digit "7" into the key pad. Thereafter, the next three digits of the access code are correctly entered by the user. This causes a transition to occur to an ALARM CODE state S13, and after a 200 milli-second time delay interval, transition to S11.

During the 200 milli-second time delay interval, as shown in FIG. 5, a signal is generated by the demultiplexer circuit 96 at its output terminal 9 and supplies it to a remotely located silent alarm circuit 270. The circuit 270 then generates an alarm to indicate that an unauthorized entry under duress is occurring, whereby help can be summoned immediately.

When the alarm code is thus entered, the sequence of events occur as described previously to cause an ultimate entrance into the OPEN state S05, so that the user can, in fact, open the safe door so that the unauthorized person will not suspect that the alarm has been generated.

A state S06C is also an OPEN state similar to the state S03C for a similar purpose. Additionally, states S14, S15 and S16 are provided for the multi-user mode of operation.

The micro-computer 48 monitors all of the following conditions and states of the safe: the door, the bolts, the power supplied thereto, electro-static interference, EMT, temperature extremes, keyboard operation, self status, operator duress, card/coins, display switches, physical abuse and unauthorized user manipulation.

While a particular embodiment of the present invention has been disclosed, it is to be understood that various different modifications are possible and are contemplated within the true spirit and scope of the appended claims. There is no intention, therefore, of limitations to the exact abstract or disclosure herein presented.

We claim:

1. An electrically controlled locking apparatus for door means, comprising:

means including a control linkage for locking said door means;

mechanical combination lock means operatively connected to said control linkage and having actuator means therefor mounted to be accessable from the non-protected side of said door means, for actuating said control linkage to cause the releasing of said door means;

electrically decoded lock control circuit means having input means and output means, said input means mounted to be accessible from the non-protected side of said door means for receiving electrical code signals indicative of an access code entered by a user attempting to release said door means, said circuit means generating an output electrical signal when said code signals indicate the receipt of the correct access code; and means responsive to said output signal for actuating said control linkage to cause the releasing of said door means, whereby said means for locking said door means causes the releasing of said door means in response to either said mechanical combination lock means or said electrical circuit means.

2. An electrically controlled locking apparatus according to claim 1, further including a coin mechanism coupled to said control circuit activated by currency for enabling said control circuit.

3. An electrically controlled locking apparatus according to claim 1, further including disruption switch means for inhibitiing said control circuit to prevent it from releasing said door means for a pre-determined time delay interval in response to a disruption.

4. An electrically controlled locking apparatus according to claim 1, further includes card reader means coupled to said control circuit means, and at least one user authorization card bearing initialization information for activating, wherein said control circuit means responds to initialization information received from said card reader means for enabling said circuit means.

5. An electrically controlled locking apparatus accordint to claim 4, wherein said card includes a member having an arrangement of a plurality of windows therein, and said card reader is an optical reader for reading said arrangement of said windows.

6. An electrically controlled locking apparatus according to claim 4, wherein said control circuit includes a micro-computer.

7. An electrically controlled locking apparatus according to claim 1, wherein said circuit means includes non-volatile memory means having manual input means for enabling a desired access code to be entered and stored in said memory means by the user.

8. An electrically controlled locking apparatus according to claim 7, wherein said non-volatile memory means having display means for providing a visual indication of the selected access code, said display means being disposed on the protected side of said door means to enable an authorized attendant to open said door means by using said mechanical lock means and to verify the selected access code for said circuit means as shown by said display means.

9. An electrically controlled locking apparatus according to claim 7, wherein said control circuit means includes computer means responsive to said input means and said non-volatile means for comparing said coded signal received from said input means and said desired access code signal and for determining when said signals match.

10. An electrically controlled locking apparatus according to claim 9, wherein said control circuit means includes generating means responsive to said match signal for producing a conditioned signal for a predetermined interval of time, means responsive to said conditioned signal and to a logic signal indicative of proper functioning of said apparatus for generating said output signal.

11. An electrically controlled locking apparatus according to claim 10, wherein said means for activating said control linkage includes a solenoid, said conditioned signal is a signal of a desired voltage level for activating said solenoid, and said gating means for supplying said conditioned signal to said solenoid.

12. An electrically controlled locking appparatus according to claim 11, wherein said generating means includes capacitor means for charging to said desired level, and said control means includes means for causing said capacitor means to discharge to a level below said desired level in the event said logic signal is not generated before the end of said time interval to prevent the releasing of said door means.

13. An electrically controlled locking apparatus for door means, comprising:

means including a control linkage for locking siad door means;

electrically coded lock control circuit means having input means and output means, said input means mounted on the non-protected side of said door means for receiving electrically coded signals indicative of an access code entered by a user attempting to realease said door means, said circuit means generating an output electrical signal when said code signals indicate the receipt of the correct access code;

means responsive to said output signal for activating said control linkage to cause the releasing of said door means, said control circuit means including computer means responsive to said input means and non-volatile memory means for comparing said coded signal received from said input means and said desired access code signal to determine whether or not a match has occurred; and said control circuit means including generating means responsive to said match for producing a conditioned signal for a pre-determinded interval of time, means responsive to said conditioned signal and to a signal indicative of proper functioning of said apparatus for generating said output signal.

14. An electrically controlled locking apparatus according to claim 13, further including means for generating first and second delay intervals, and means responsive to a correct access code being entered only during said second interval.

15. An electrically controlled locking apparatus according to claim 13, further including silent alarm means responsive to a modified code being entered.

16. An electrically controlled locking apparatus according to claim 13, further including means for generating a tampering indication and temporary lockout should a series of wrong access codes be entered in said input means or should other distrubance occur.

17. An electrically controlled locking apparatus according to claim 13, further including door and control linkage sensor means responsive to the complete closure of said door means and to the complete extension of said control linkage for generating a signal indicative of the status of said locking apparatus.

18. An electrically controlled locking apparatus according to claim 13, further including power-up means for causing a low current signal to be sent from said input means for causing power to be supplied to said control circuit.

19. An electrically controlled locking apparatus according to claim 18, wherein in response to said low current signal, timing means causes the power to be removed from said control circuit after a predetermined time interval.

20. An electrically controlled locking apparatus according to claim 13, further including static prevention means for detecting the presence of unwanted occurrences including lightning and others, for causing an inhibited cycle of operation to occur.

21. An electrically controlled locking apparatus according to claim 20, wherein said static means includes conductor loop means mounted near said control circuit means.

* * * * *

UNITED STATES PATENT AND TRADEMARK OFFICE

CERTIFICATE OF CORRECTION

PATENT NO. : 4,686,912

DATED : August 18, 1987

INVENTOR(S) : H. Frank Fogleman

It is certified that error appears in the above-identified patent and that said Letters Patent are hereby corrected as shown below:

Column 6, Line 33: "batter" should read --battery--
Column 7, Line 24: "entire window" should read --entire energy window--
Column 20, Line 11: "means and" should read --means, and--

Signed and Sealed this

Twenty-ninth Day of December, 1987

*Attest:*

DONALD J. QUIGG

*Attesting Officer*

*Commissioner of Patents and Trademarks*